US009227779B2

(12) United States Patent
Kaya

(10) Patent No.: US 9,227,779 B2
(45) Date of Patent: Jan. 5, 2016

(54) CARGO CONTAINER FOR AN AIRCRAFT

(71) Applicant: Airbus Operations GmbH, Hamburg (DE)

(72) Inventor: Aykut Kaya, Bremen (DE)

(73) Assignee: Airbus Operations GmbH (DE)

( * ) Notice: Subject to any disclaimer, the term of this patent is extended or adjusted under 35 U.S.C. 154(b) by 0 days.

(21) Appl. No.: 14/547,477

(22) Filed: Nov. 19, 2014

(65) Prior Publication Data

US 2015/0144640 A1 May 28, 2015

(30) Foreign Application Priority Data

Nov. 26, 2013 (DE) ..... 10 2013 113 057

(51) Int. Cl.

*B65D 88/14* (2006.01)
*B65D 90/22* (2006.01)
*B65D 90/32* (2006.01)

(52) U.S. Cl.

CPC ..... *B65D 88/14* (2013.01); *B65D 90/22* (2013.01); *B65D 90/32* (2013.01); *B65D 2590/0083* (2013.01)

(58) Field of Classification Search

CPC ..... B65D 88/12; B65D 85/00; B65D 90/22; B65D 90/32; B65D 2590/0083; B65D 88/14
USPC ..... 220/560.07, 560.11, 560.01, 88.1, 23.9, 220/62.21
See application file for complete search history.

(56) References Cited

U.S. PATENT DOCUMENTS

| | | | | |
|---|---|---|---|---|
| 6,189,624 | B1 * | 2/2001 | James | 169/61 |
| 8,382,033 | B2 | 2/2013 | Reece | |
| 8,397,441 | B2 | 3/2013 | Wallance | |
| 2003/0111476 | A1 * | 6/2003 | Serio, Jr. | 220/835 |
| 2004/0211150 | A1 | 10/2004 | Bobenhausen | |
| 2008/0134589 | A1 * | 6/2008 | Abrams et al. | 52/79.1 |
| 2010/0276539 | A1 * | 11/2010 | Brinkmann et al. | 244/121 |
| 2012/0111364 | A1 * | 5/2012 | Pruyn | B28C 5/4203 134/10 |

FOREIGN PATENT DOCUMENTS

DE 10 2009 045 992 A1 4/2011

OTHER PUBLICATIONS

German Search Report dated Jan. 31, 2014 (10 2013 113 057.7).

* cited by examiner

*Primary Examiner* — Robert J Hicks
*Assistant Examiner* — Kareen Thomas
(74) *Attorney, Agent, or Firm* — Lerner, David, Littenberg, Krumholz & Mentlik, LLP

(57) ABSTRACT

A cargo container for accommodating transport goods and for being arranged in a cargo compartment of a means of transport is provided. The cargo container includes a housing that can be closed so that it is airtight, and an internal coating. The internal coating is incombustible and is arranged on an inner surface of the housing. Thus, the cargo container makes it possible to limit propagation of a fire to the internal space of the housing.

6 Claims, 1 Drawing Sheet

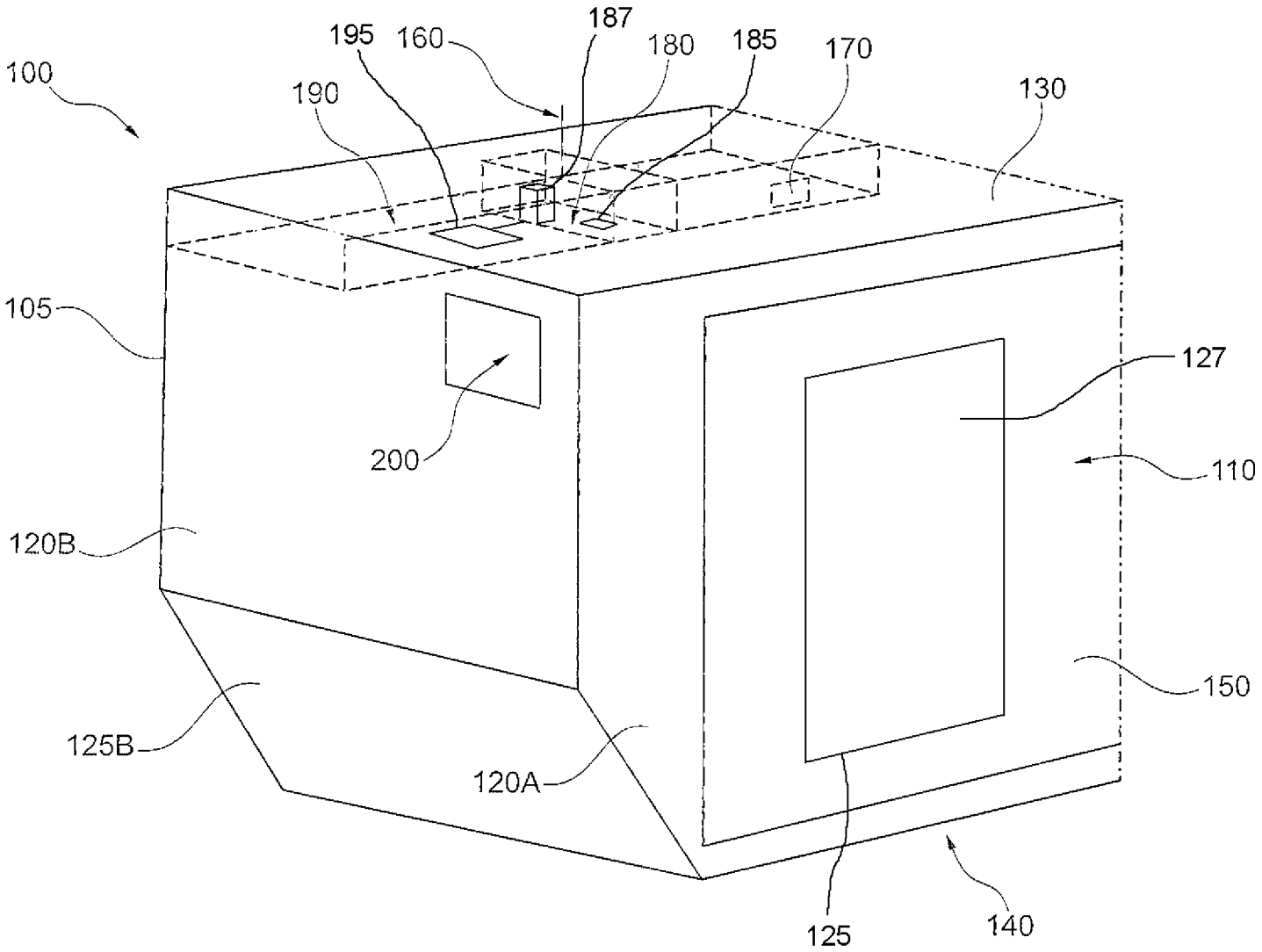
100
105
120B
125B
190
195
160
187
180
185
170
130
127
110
150
140
125
120A
200

CARGO CONTAINER FOR AN AIRCRAFT

FIELD OF THE INVENTION

The invention relates to a cargo container for accommodating transport goods and for being arranged in a cargo compartment of a means of transport, in particular to a cargo container for being arranged in a cargo compartment of an aircraft.

BACKGROUND OF THE INVENTION

Cargo containers are used in order to be loaded with transport goods and in order to be arranged in means of transport. Transport goods can, for example, be the baggage of passengers of an aircraft, or generally items for being shipped that are transported in a means of transport, for example in or on a ship, a rail vehicle, a road vehicle or an aircraft.

Transport goods can be loaded into the cargo container beforehand, independently of the loading of the means of transport. The external dimensions of a cargo container can, in particular, match the internal dimensions or the internal space geometry of the cargo compartment of the means of transport.

The use of cargo containers for the loading of means of transport can reduce the time taken for loading and can make optimum use of an available internal space in the cargo compartment of the means of transport. Furthermore, with the use of cargo containers the weight distribution of the cargo in a means of transport can be influenced.

In a cargo compartment a multitude of cargo containers of an identical design can be used. In the case of cargo compartments with an asymmetric internal space geometry two or more cargo containers with a correspondingly matching external geometry can be provided. Several cargo containers can be arranged one behind the other in the longitudinal direction of the cargo compartment, thus forming a row. In a cargo compartment several rows of cargo containers can be arranged one beside the other and also one on top of the other.

BRIEF SUMMARY OF THE INVENTION

An aspect of the invention may provide a cargo container that makes it possible to make use of a simplified design of a cargo compartment of a means of transport.

According to an aspect a cargo container for accommodating transport goods and for being arranged in a cargo compartment of a means of transport is provided. The cargo container comprises a housing that can be closed so that it is airtight, and an internal coating. In this design the internal coating is fire resistant and is arranged on an internal surface of the housing.

A cargo container is a transport container that makes it possible to stow freight or baggage and that is loaded into a cargo compartment of a means of transport. The cargo container can, in particular, be geometrically designed so that it can be arranged in an internal space of a cargo compartment. A cargo container can, for example, have edge dimensions of several meters in length, width and height.

A cargo container designed in this manner can make possible a simplified design of a cargo compartment because in particular as a result of the presence of the fire resistant internal coating an incombustible internal coating of the entire cargo compartment, which internal coating may be required, can be designed so as to be dimensionally reduced.

This can reduce the unladen weight of the means of transport and increase the internal dimensions of the cargo compartment.

In other words the cargo container comprises a fire resistant internal coating, and consequently the unladen weight of a means of transport is reduced, and the weight of the fire resistant internal coating influences the total mass of a means of transport only in the case of the cargo containers being loaded in the means of transport.

The cargo container is airtight, which means that essentially no air exchange, in particular no unintended air exchange, takes place between the internal space of the cargo container and the surroundings. This can prevent a fire from breaking out or from propagating, or it can reduce the danger of a fire breaking out or propagating.

According to an embodiment the internal coating extends over the entire internal surface of the housing.

The housing can be of a predetermined shape that essentially is cuboid. The shape of the lateral surfaces of the housing can match the spatial or geometric circumstances or shapes of the cargo compartment.

The fire resistant internal coating, which extends over the entire internal surface of the housing, thus encloses the internal space of the housing along the shapes of the lateral surfaces of the housing.

According to a further embodiment the internal coating comprises S-glass.

S-glass is a special glass that features high mechanical strength, in particular tensile strength and rigidity, and high chemical resistance.

According to a further embodiment the housing comprises a decompression arrangement.

The decompression arrangement can be a decompression flap that by means of predetermined breaking points is mechanically coupled to a lateral surface of the housing. In this design the predetermined breaking points are designed so that in the case of a sudden pressure difference arising between the internal space of the housing and the surroundings they break and open a housing opening so that rapid pressure equalization between the internal space of the housing and the surroundings can occur.

A decompression arrangement can, in particular, be necessary and mandatory in the use of the cargo container in an aircraft, for example in the case of a rapid change in pressure, i.e. rapid decompression, RD.

The decompression arrangement can be designed so that it can only be opened in one direction, namely from the inside to the outside. This means that the decompression arrangement is designed to open only if the internal pressure exceeds a predetermined difference relative to the ambient pressure, in other words if the internal pressure is greater by this difference relative to the external pressure. Conversely (in the case where the external pressure or ambient pressure is greater than the internal pressure) according to one embodiment the decompression arrangement will not open.

In RD analyses of means of transport, in particular of aircraft, all the connecting surfaces between volumes that are determined in analysis methods are considered. In this process, in particular, decompression flaps in the cladding of cargo compartments play a role in order to make it possible, in RD cases, for an airstream to flow into, or out of, the cargo compartments. An open cargo compartment would render decompression flaps in the cladding superfluous, wherein, however, cargo compartments without cladding would possibly fail to comply with other requirements relating to the design of cargo compartments.

As a result of individual cargo containers comprising a decompression arrangement and cargo compartments no longer requiring RD flaps, other RD-specific components that are located in the means of transport, such as, for example dado panels, can be correspondingly adapted, which results in a reduction of the unladen weight of the means of transport. In an aircraft, dado panels are, for example, located in the cabin as part of the lining; they comprise ventilation areas for normal air conditioning purposes and RD purposes between the cabin and the lower deck.

The so-called RD differential pressures that act in the upwards or downwards direction onto the floor of a cargo compartment can be reduced. The open cargo compartments with airproof and fireproof cargo containers, as described above and below, for example in an aircraft prevent higher differential pressures from arising between the cabin and the cargo compartments (or between above and below the floor, in other words on both sides of a horizontal separating layer between two spaces in an aircraft). These pressures can at times be sufficiently high so that they have to be taken into account in the dimensioning of the floor.

A cargo container as described above and below can, in particular, make possible the provision of an open cargo compartment because the requirements relating to the cargo compartment can be met by the cargo container.

As a result of a cargo compartment modified or modifiable in such a manner, the time and the expenditure of producing an aircraft can be reduced.

According to a further embodiment the housing comprises a pressure equalization valve.

In contrast to the decompression arrangement, the pressure equalization valve is provided to achieve slow pressure equalization between the internal space and the surroundings of the housing in both directions, in other words to either increase or decrease the internal pressure in that air enters the internal space or escapes from the internal space by way of the pressure equalization valve.

According to a further embodiment the housing comprises a receiving space for a fire sensor and a fire sensor arranged therein.

The receiving space for the fire sensor can, in particular, be arranged on a cover surface of the housing and in particular in the internal space of the housing.

The fire sensor can, for example, be a mechanical, optical or chemical fire sensor or a combination of these fire detection mechanisms, and can, for example, be designed to detect any change in temperature over time, any smoke development or any increase in certain chemical particles in the internal space of the housing.

In the case of a fire, spatial confinement of the fire to a single cargo container can take place as a result of the fireproof internal coating of a cargo container so that the fire cannot spread to the entire cargo compartment. Furthermore, as a result of a cargo container comprising a fire sensor, precise information relating to the source of the fire can be obtained. Furthermore, as a result of an appropriate distribution of the fire extinguishing agent to the cargo containers the overall quantity of fire extinguishing agent carried in the means of transport can be reduced.

The cargo container can also comprise several receiving spaces for fire sensors and respective individual or several fire sensors arranged therein, which fire sensors can, for example, also be arranged on a lateral surface of the housing.

According to a further embodiment the housing comprises a receiving space for a fire extinguishing agent and a fire extinguishing agent arranged therein.

The receiving space for the fire extinguishing agent can, in particular, be arranged on a cover surface of the housing and in particular in the internal space of the housing.

In a further embodiment the housing comprises further receiving spaces for fire extinguishing agent, which receiving spaces can also be arranged on a lateral surface in the internal space of the housing.

The fire extinguishing agent can be in liquid or in powder form and in the case of a fire detected in the cargo container can be emitted into the internal space of the housing.

According to a further embodiment the housing comprises a discharge element for fire extinguishing agent, wherein the discharge element for fire extinguishing agent is designed, in the case of a fire in the cargo container, to discharge a fire extinguishing agent into the internal space of the housing.

According to a further embodiment the receiving space for the fire sensor, the receiving space for the fire extinguishing agent, and the discharge element for the fire extinguishing agent are arranged in an internal space of the housing.

According to a further embodiment the housing comprises a loading opening that is arranged on a lateral surface of the housing and that can be closed by means of a loading flap.

According to a further aspect an aircraft comprising a cargo compartment is provided, wherein in the cargo compartment a multitude of cargo containers as described above and below are arranged and are mechanically coupled to the cargo compartment. In this arrangement the cargo containers are also coupled to the aircraft in such a manner that sensor data from the cargo container can be transmitted to a central evaluation unit for monitoring the cargo containers, in particular data relating to any fire detection in the internal space of a cargo container.

In other words an exemplary cargo container for use in an aircraft can be described as follows: usually aircraft such as passenger aircraft comprise cargo compartments that are arranged in a lower deck, wherein in a cargo aircraft the main deck is also used for loading freight. In passenger aircraft the cargo compartment is used for baggage or other cargo belonging to passengers. Usually, cargo compartments need to be designed so as to be airtight and fireproof. The cargo container as described above and below reflects this specification at the level of the cargo containers so that the cargo compartment can possibly be designed differently, as has already been explained above. In the case of a fire in an aircraft it may be necessary for the pilot in command to land the aircraft within the shortest possible time. Likewise, it may be required that within a predetermined period of time after the outbreak of a fire in the cargo compartment a message is issued to the pilot in command and a fire extinguishing system is activated. In the case of a fire, airtightness and fireproofness are important characteristics in containing or preventing the propagation of the fire. Despite the requirement for airtightness, in the case of rapid decompression (RD) pressure equalization must be made possible, which takes place by way of the decompression device. To ensure pressure equalization between an airtight cargo compartment and its surroundings, pressure equalization valves can be provided in the walls of the cargo compartment, which pressure equalization valves open up if there are small pressure differentials between the cargo compartment and the surroundings, and thus allow airflow in both directions, in particular during takeoff and landing of an aircraft, when the cabin pressure is reduced or increased again. In the case of rapid decompression (RD), for example experienced as a result of damage to the fuselage of the aircraft, adequate air exchange to and from the cargo compartment may be required in order to protect the primary structure of the aircraft from damage. Such air exchange can be made possible by the provision of decompression flaps. Fireproofness of the cargo compartment is usually achieved with the use of incombustible or fire-retardant materials in the construction. Furthermore, a fire alarm system and a fire extinguishing system can be installed. In the case of a fire within the cargo compartment, temperatures can rise to approx. 1,000° C. or higher. The materials used in the internal coating need to withstand these temperatures and must not fail within a predetermined period of time. Usually, among other materials, titanium is used for this, for example in the construction of the framework of the decompression arrangement. The internal coating can be made from S-glass that comprises characteristics such as, for example, low combustibility, high ageing resistance and weather resistance as well as chemical resistance. In order to keep a fire that has broken out under control or in order to extinguish it, this fire first needs to be detected, for which purpose one or several fire alarms are provided, which can, for example, be arranged in the internal coating of the cargo compartment. For example halon can be used as an extinguishing substance, which is also tolerated in civil aviation applications. However, the extinguishing substance needs to be carried on board; it requires transportation space and has a certain dead weight. The extinguishing substance is usually stored in a central location and when required is conveyed to the source or sources of fire by way of pipes.

The requirements relating to the cargo compartment, which requirements have been set out above, can at least in part be met by a cargo container as described above and below so that the construction of the cargo compartment can be simplified and the unladen weight of the aircraft can be reduced The cargo container can comprise external contours that match the internal contours of the cargo compartment. A loading opening that can be closed by means of a loading flap makes possible the loading and unloading of the cargo container, as well as its airproof and fireproof closure. The loading flap can be made from the same material as the internal coating of the cargo container, or it can comprise such an internal coating.

At the ceiling or at a lateral surface the cargo container comprises a chamber that is separate of the internal space, which chamber provides sufficient space for the arrangement of a fire alarm, a fire extinguisher element with a fire suffocation substance, and a pressure equalization valve and which are arranged therein. On a lateral surface an RD panel is arranged whose size depends on, or correlates to, the size or the volume of the cargo container.

The cargo container can comprise a signal interface by way of which the cargo container can be coupled to the means of transport, for example in order to emit a signal when a fire has been detected in the cargo container so that the person in charge of the means of transport is informed about the fire. The signal interface can also indicate whether a cargo container is in effect present at all in a load position in the cargo compartment.

As a result of the provision of a cargo container as described above and below, the internal coating in a cargo compartment can be reduced. Likewise, the on-board supply of halon bottles can be reduced or can be done without entirely. If a cargo compartment is designed correspondingly, it may be specified that such a cargo compartment must only contain cargo containers as described above and below.

The unladen weight of the means of transport is reduced by the value of the reduced internal coating of the cargo compartment. This can also result in a reduction in the operating costs of the means of transport.

In the case of a fire breaking out within a cargo container, propagation of the fire can be limited to the corresponding cargo container. By means of the fire alarm or the fire sensor the person in charge of the means of transport knows in which particular cargo container the fire has broken out. In this way it is also possible to reduce any danger or damage, resulting from a fire, to the crew, to passengers and to the means of transport.

One exemplary embodiment of the cargo container is described below with reference to the FIGURE. The illustrations in the FIGURE are diagrammatic and not to scale.

BRIEF DESCRIPTION OF THE DRAWINGS

The FIGURE shows a diagrammatic view of a cargo container according to an exemplary embodiment of the invention.

DETAILED DESCRIPTION

The FIGURE shows a cargo container 100 comprising a housing 105. The housing is cuboid shaped and encloses an internal space 110. In a closed state of the housing 105 the internal space 110 is completely enclosed by the lateral surfaces 120A, 120B, the lateral surfaces located in the background and not shown in the drawing, by a cover surface 130 and by a base surface 140.

The lateral surface 120B comprises a beveled section 125B. This beveled section 125B can, in particular, be provided because of adaptation of the external geometry of the housing 105 to an internal geometry of a cargo compartment of a means of transport.

The housing 105 comprises a decompression arrangement 200 in the form of a panel in the lateral surface 120B.

The lateral surface 120A comprises a loading opening 125 that can be closed by means of a loading/unloading door or flap 127.

In the internal space 110 of the housing 105, on the cover surface 130, there are several receiving spaces for functional elements.

The receiving space 180 accommodates a fire sensor 185 and a fire extinguisher head 187. The fire sensor 185 is designed to detect a fire in the internal space 105. The fire extinguisher head 187 is designed in the case of a fire in the internal space 105 to spray a fire extinguishing agent 195.

The receiving space 190 is designed to receive a fire extinguishing agent 195 which in the case of a fire is sprayed by way of the fire extinguisher head 187.

In addition, the housing 105 comprises a pressure equalization valve 170 which is, for example, arranged on the cover surface 130. As an alternative, the pressure equalization valve 170 can be arranged in a lateral surface of the housing.

Finally, the housing also comprises an interface 160 by way of which signals can be transmitted to a central monitoring unit in a means of transport.

By way of the interface 160 it is possible, in particular, to transmit information as to whether or not a container space comprises a cargo container, and information relating to any change in the state of the fire sensor.

By way of the interface 160 it is also possible for signals to be transmitted from a central control and monitoring unit to the cargo container or to the elements of the cargo container. For example, by way of the interface 160 a pilot in command can cause transmission of a signal for triggering the fire extinguisher element. Thus, the fire extinguisher element can be automatically triggered by way of the fire sensor and can be manually triggered by way of the interface 160 so that the fire extinguishing agent is distributed in the cargo container.

The invention claimed is:

1. A cargo container for accommodating transport goods and for being arranged in a cargo compartment of an aircraft, the cargo container comprising:

a housing configured to be closed so that the housing is airtight; and an internal coating;

wherein the internal coating is fire resistant and is arranged on an internal surface of the housing;

wherein the housing comprises a first receiving space for a fire sensor and a fire sensor arranged therein;

wherein the housing comprises a second receiving space for a fire extinguishing agent and a fire extinguishing agent arranged therein, wherein the housing comprises a discharge element for the fire extinguishing agent, wherein the discharge element for the fire extinguishing agent is configured in case of a fire in the cargo container to discharge the fire extinguishing agent into an internal space of the housing, and wherein the first receiving space for the fire sensor, the second receiving space for the fire extinguishing agent and the discharge element for the fire extinguishing agent are arranged in the internal space of the housing.

2. The cargo container according to claim 1, wherein the internal coating extends over the entire internal surface of the housing.

3. The cargo container according to claim 1, wherein the internal coating comprises S-glass.

4. The cargo container according to the preceding claim 1, wherein the housing comprises a decompression arrangement.

5. The cargo container according to the preceding claim 1, wherein the housing comprises a pressure equalization valve.

6. The cargo container according to the preceding claim 1, wherein the housing comprises a loading opening arranged on a lateral surface of the housing and is configured to be closed by a loading flap.

* * * * *